US007343117B2

(12) United States Patent
Otoguro et al.

(10) Patent No.: US 7,343,117 B2
(45) Date of Patent: Mar. 11, 2008

(54) ELECTRONIC APPARATUS HAVING A PLURALITY OF CIRCUIT SUBSTRATES

(75) Inventors: Yasuaki Otoguro, Ibaraki (JP); Hajime Sekiguchi, Chiba (JP); Fukashi Hatano, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 262 days.

(21) Appl. No.: 10/836,208

(22) Filed: May 3, 2004

(65) Prior Publication Data

US 2005/0047819 A1 Mar. 3, 2005

(30) Foreign Application Priority Data

Sep. 1, 2003 (JP) ..... 2003-308781

(51) Int. Cl.
*G03G 15/00* (2006.01)

(52) U.S. Cl. ..... 399/107; 399/90; 361/725; 361/726; 361/727

(58) Field of Classification Search ..... 399/107, 399/90; 361/614, 671, 727, 725, 726
See application file for complete search history.

(56) References Cited

U.S. PATENT DOCUMENTS 5,335,146 A * 8/1994 Stucke ..... 361/785
5,663,622 A 9/1997 Sekiguchi ..... 318/563
5,669,040 A * 9/1997 Hisatake ..... 399/83
5,684,674 A * 11/1997 Yin ..... 361/695
5,918,089 A * 6/1999 Malinich et al. ..... 399/90

FOREIGN PATENT DOCUMENTS

JP 2001-238045 8/2001

* cited by examiner

*Primary Examiner*—David M. Gray
*Assistant Examiner*—Bryan Ready
(74) *Attorney, Agent, or Firm*—Fitzpatrick, Cella, Harper & Scinto

(57) ABSTRACT

An image forming apparatus including a first circuit substrate, a second circuit substrate, a first supporting member for supporting the first circuit substrate, a second supporting member for supporting the second circuit substrate, a holding member for holding the first supporting member and the second supporting member, and a connector for cablelessly connecting the first circuit substrate and the second circuit substrate together, wherein at least one of the first supporting member and the second supporting member is movable in a direction in which the connection by the connector is released, and the first supporting member and the second supporting member are mountable to and dismountable from the holding member independently of each other.

4 Claims, 5 Drawing Sheets

ELECTRONIC APPARATUS HAVING A PLURALITY OF CIRCUIT SUBSTRATES

BACKGROUND OF THE INVENTION

1. Field of the Invention

The invention relates to the layout design and mounting and dismounting of a circuit substrate in an electronic apparatus such as, for example, a printer or a copying machine.

2. Description of the Related Art

In recent years, there have been popularized image forming apparatuses such as printers and copying machines using an electrophotographic process which can output a full-color image.

Description will hereinafter be made with reference to the accompanying drawings. FIG. 5 shows an example of the construction of the essential portions of a conventional full-color printer. A photosensitive drum (hereinafter simply referred to as the photosensitive member) 1 as an image bearing member is provided so as to be rotatable in the direction indicated by the arrow A by a motor (not shown). Around the photosensitive member 1, there are disposed a primary charging device 7*a*, an exposing apparatus 8, a developing unit 13, a transfer roller 10 and a cleaner apparatus 12.

The developing unit 13 has four developing apparatuses 13Y, 13M, 13C and 13K for full-color developing. The developing apparatuses 13Y, 13M, 13C and 13K develop a latent image on the photosensitive member 1 with yellow (Y), magenta (M), cyan (C) and black (K) toners. When the latent image is to be developed with the toner of each color, the developing unit 13 is rotated in the direction indicated by the arrow R by a motor (not shown), and the developing apparatus of that color is positioned so as to come into contact with the photosensitive member 1.

The toner images of the respective colors developed on the photosensitive member 1 are successively transferred to a belt 2 as an intermediate transfer member by the transfer roller 10, and the toner images of the four colors are superimposed one upon another. The belt 2 is stretched over rollers 17, 18, 19 and 20. Of these, the roller 17 functions as a drive roller coupled to a drive source (not shown) and driving the belt 2, and drives the belt 2 in the direction indicated by the arrow B. The roller 19 functions as a tension roller for adjusting the tension of the belt 2, and the roller 20 functions as a backup roller for a transfer roller 21.

A belt cleaner 22 is provided at a location opposed to the roller 17 with the belt 2 interposed therebetween, and any residual toners on the belt 2 are scraped off by a blade.

A recording sheet drawn out of a recording sheet cassette 23 or 24 to a conveying path by a pickup roller 25*a* or 26*a* and a pair of separating rollers 25*b* or 26*b* is directed to a pair of registration rollers 29 by a pair of rollers 27 or 28. The recording sheet once stopped at the nip portion of the pair of registration rollers 29 is fed to a secondary transfer nip portion, i.e., the portion of contact between a secondary transfer roller 21 and the belt 2, in timed relationship with the toner images on the belt 2. The toner images formed on the belt 2 are transferred onto the recording sheet at this nip portion, and are heat-fixed by a fixing apparatus 5, and the recording sheet is discharged to a tray 30.

In the color printer of the above-described construction, an image is formed in the following manner. First, a voltage is applied to the charging device 7*a* to thereby minus-charge the surface of the photosensitive member 1 uniformly at predetermined charging portion potential. Subsequently, the exposing apparatus 8 including a laser scanner or the like scans the photosensitive member 1 by a laser beam modulated in accordance with an image signal, whereby a latent image corresponding to an image is formed.

A developing bias preset for each color is applied to the developing roller of the developing apparatus 13Y or the like, and the latent image formed on the photosensitive member 1 is developed with a toner when it passes the position of the developing roller, and is visualized as a toner image. The toner image is transferred to the belt 2 by the transfer roller 10, and a toner image of a first color is formed on the belt 2. This operation is repeated four times (correspondingly to the four colors), whereby toner images of the four colors are formed on the belt 2. At that time, the transfer roller 21 as a secondary transfer apparatus is spaced apart from the belt 2 by a mechanism (not shown) for moving it toward and away from the belt. The belt cleaner 22 is also spaced apart from the belt 2 by a mechanism (not shown) for moving it toward and away from the belt.

After the toner images of the four colors have been transferred and immediately before the leading edge of the toner images comes to the position of the roller 20, the secondary transfer roller 21 is brought into contact with the belt 2 by the mechanism for moving it toward and away from the belt, and the toner images are transferred to the recording sheet at the nip portion thereof. The recording sheet to which the toner images have been transferred is fed to the fixing apparatus 5, whereby the toner images are fixed as a full-color image. Any toners residual on the photosensitive member 1 are removed and collected by the cleaner apparatus 12 and lastly, the photosensitive member 1 is charge-eliminated uniformly to the vicinity of 0 volt by a charge eliminating apparatus 7*b*, and becomes ready for the next image forming cycle.

In such an image forming apparatus, there are carried a plurality of electric cables for effecting the exchange of electric power and data among various electric circuit substrates for controlling various operations.

These electric circuit substrates include an AC power source circuit substrate for introducing electric power from a commercially available AC power source, a high voltage source circuit substrate for generating a high voltage for forming a toner image on the image bearing member, a DC power source circuit substrate for driving a motor or the like, and a control circuit substrate for controlling the driving of these circuits. Also, the above-described plurality of circuit substrates are connected together by cables for electrical energization.

The installation places of the electric circuit substrates exist at all locations in the image forming apparatus from the use and the positional relation or the like with other parts, and along therewith, the cables connecting the substrates together are also installed at all locations in the image forming apparatus.

In such an electrical arrangement using a plurality of cables, the distance between the AC component cable and the DC component cables is short and therefore, noise may shift from the AC component cable to the DC component cable to thereby give rise to the problem of adversely affecting the formed image or spoiling the stable operation of the apparatus. Also, in the DC component cable, a great deal of noise occurs from the circuit substrate transmitting and receiving data of a high clock.

At present, as a countermeasure for this, there is used a countermeasure adopting a cableless connecting method of providing a covering material for electrically shielding the surfaces of the cables, or extending the cables at such an arrangement that the distance between the AC cable and the DC cable becomes long, or directly connecting respective connectors installed on the circuit substrates.

As an example, the invention described in Japanese Patent Application Laid-Open No. 2001-238045 achieves a reduction in noise by covering a harness (flat cable) which is a noise causing source with a shield member exclusively therefor.

Also, in the conventional image forming apparatus, in order to accurately hold a unit concerned in image forming, including these electric members, two pairs of large metal plates are used to form a frame (side plates).

However, the method of providing a covering material for electrically shielding the surfaces of the cables as in the above-described example of the conventional art leads to a great increase in cost, and the method of extending the cables so that the distance between the AC cable and the DC cable may become long results in the greater lengths of the AC cable and the DC cable or the complication of wiring, thus reducing the maintenance property of other parts.

Also, the method of directly connecting the respective connectors installed on the circuit substrates has resulted in the aggravation of the working property during assembly because the circuit substrates are connected together, and thereafter are assembled to an apparatus main body.

Also, as regards supporting plates, metal plates of substantially the same size as that of the image forming apparatus have been used and this has caused the bulkiness (increased cost) of a molding machine and an increase in conveying cost.

SUMMARY OF THE INVENTION

The present invention has been made in view of such problems and an object thereof is to provide an electronic apparatus provided with electric circuit substrates having a cableless connecting method, which is enhanced in working property and maintenance property, and is low in cost and yet realizes lower noise.

In order to achieve the above object, as an embodiment of the present invention, there is provided an electronic apparatus having a first circuit substrate, a second circuit substrate, a first supporting member for supporting the first circuit substrate, a second supporting member for supporting the second circuit substrate, a holding member for holding the first supporting member and the second supporting member, and a connector for cablelessly connecting the first circuit substrate and the second circuit substrate together, wherein at least one of the first supporting member and the second supporting member is movable in a direction in which the connection by the connector is released, and the first supporting member and the second supporting member are detachable from the holding member independently of each other.

Also, as another embodiment of the present invention, there is provided an electronic apparatus having a first plate, a second plate, a connecting portion for connecting the first plate and the second plate together, a first cable and a second cable, wherein the connecting portion is a grounded electrically conductive member, and the first cable and the second cable are spaced apart from each other by the connecting portion.

Also, as another embodiment of the present invention, there is provided an electronic apparatus having a first plate, a second plate, a fixing member fixed astride the first plate and the second plate, a first cable and a second cable, wherein the fixing member is a grounded electrically conductive member, and the first cable and the second cable are spaced apart from each other with the fixing member interposed therebetween.

Other objects and features of the present invention will become apparent from the following description and the accompanying drawings.

DESCRIPTION OF THE PREFERRED EMBODIMENTS

Some embodiments of the present invention will hereinafter be described with reference to the accompanying drawings.

Figure 1:
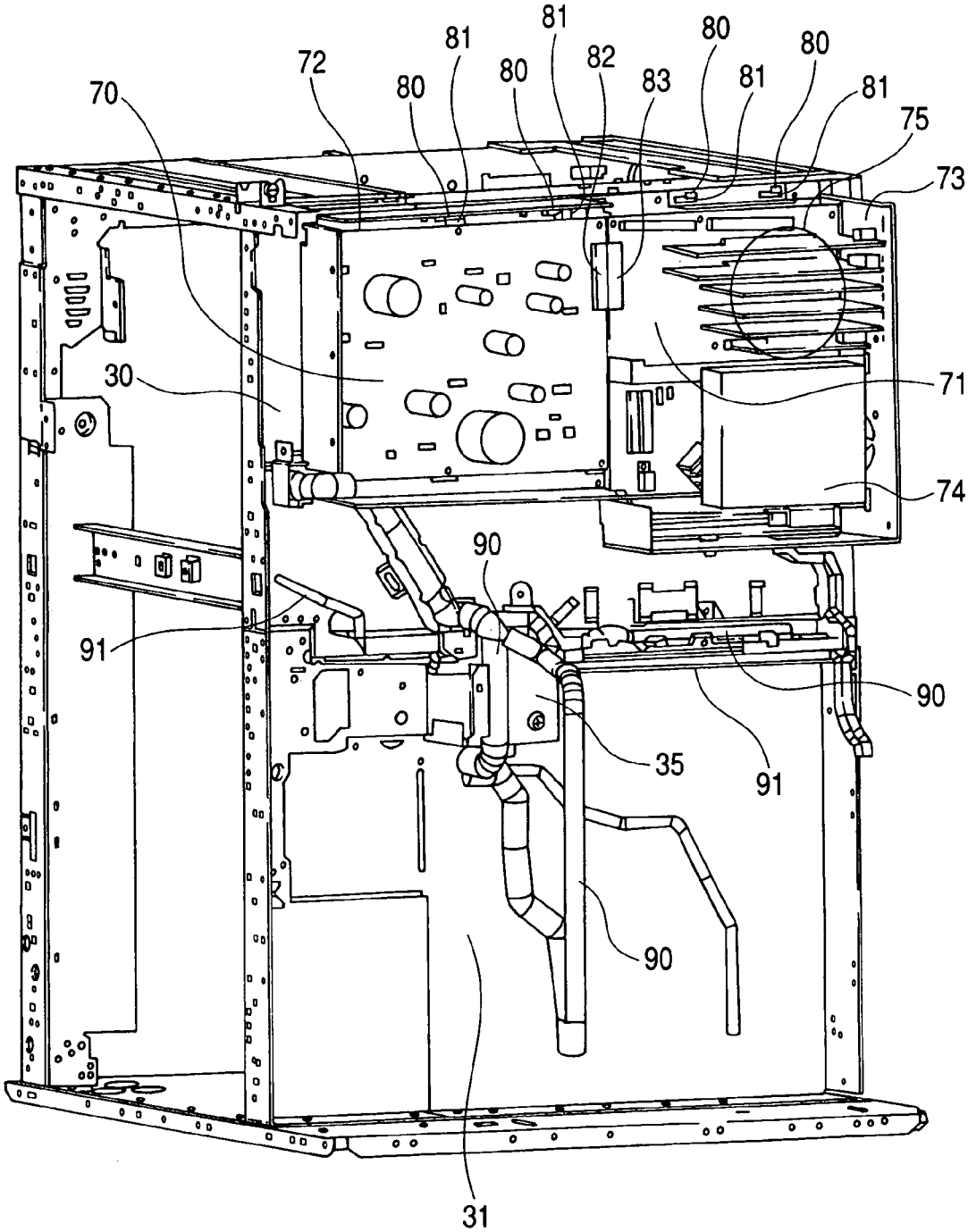
FIG. 1 shows the construction of an image forming apparatus as it is seen from the rear thereof.
Figure 2:
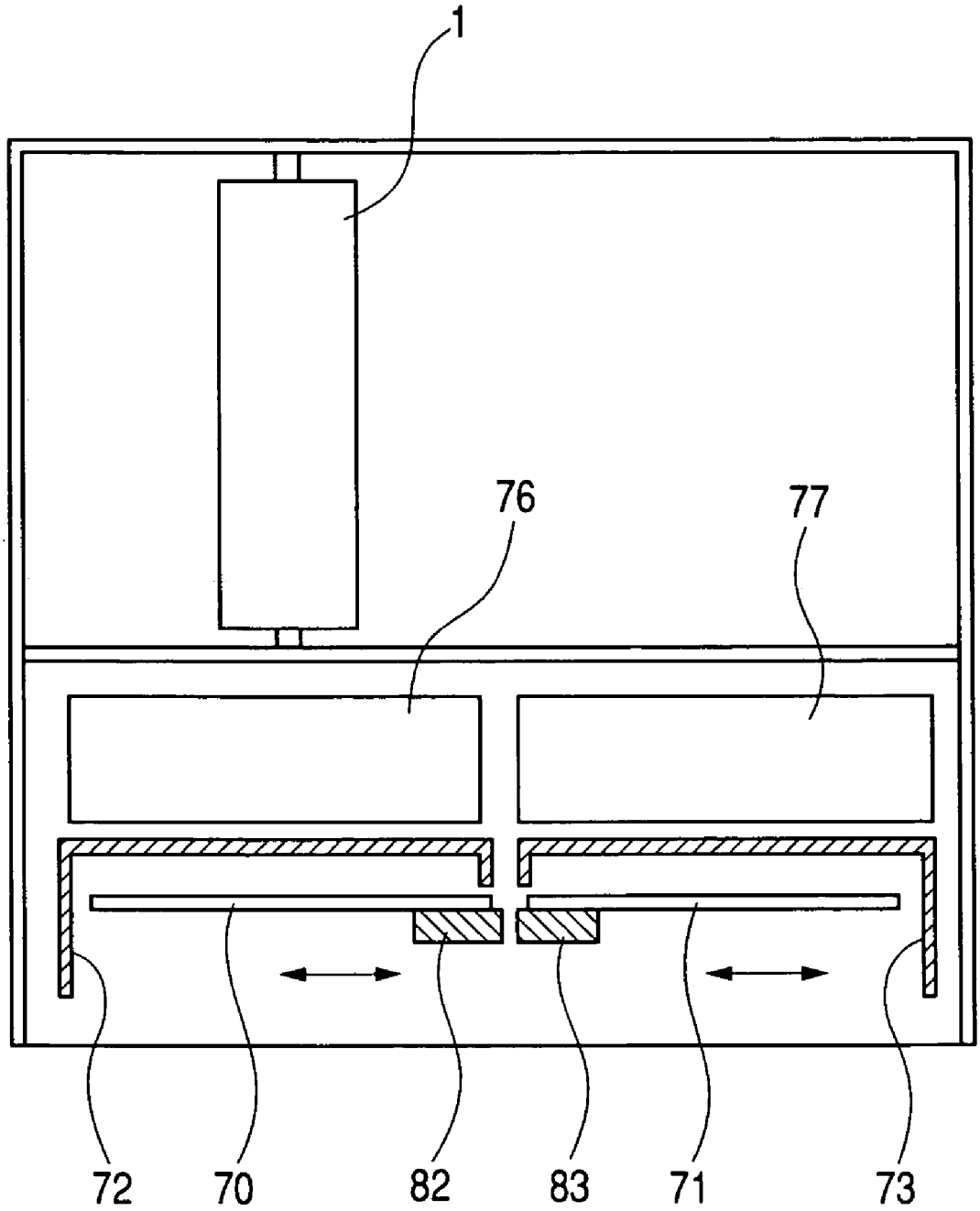
FIG. 2 shows the construction of the image forming apparatus as it is seen from above it.
Figure 3:
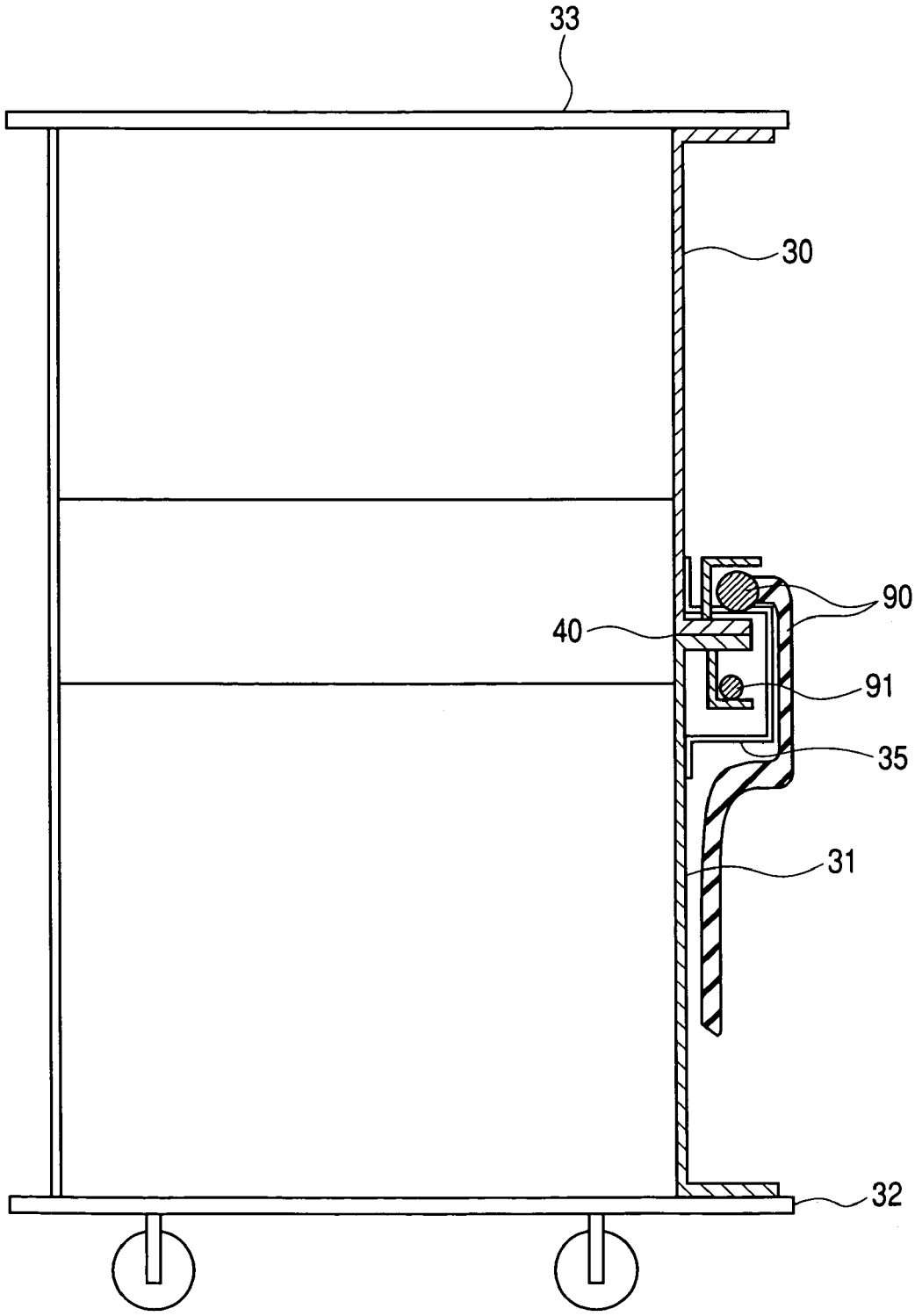
FIG. 3 shows the construction of the image forming apparatus as it is seen from a side thereof.

An embodiment of the present invention will first be described with reference to the accompanying drawings. The functionally same portions as those in the example of the conventional art are given the same reference numerals and need not be described. FIGS. 1, 2 and 3 are schematic views illustrating the present invention.

FIG. 1 shows the construction of an image forming apparatus to which the present invention is applied as it is seen from the rear thereof, FIG. 2 shows the construction of the image forming apparatus as it is seen from above it, and FIG. 3 is a cross-sectional view of the image forming apparatus as it is seen from a side thereof.

A first supporting member 73 (hereinafter referred to as the controller box) is a member provided on the rear portion of an apparatus main body for supporting a control circuit substrate (controller substrate) 71 for controlling the operation of each circuit, a recording medium (hard disk) 74 in which data necessary when an image is processed is contained, a circuit substrate 75 for effecting the exchange of data with an apparatus outside the image forming apparatus, etc.

A second supporting member 72 (hereinafter referred to as the drive control box) is a member provided on the rear portion for supporting a circuit substrate 70 for effecting the control of motor drive. The respective circuit substrates are fixed to the supporting members by screws.

The controller box 73 and the drive control box 72 are arranged side by side and are secured to the apparatus main body by screws. The controller substrate 71 and the circuit substrate 70 are connected together by connectors 82 and 83 disposed on the respective substrates.

Consequently, a code for electrical energization for connecting the circuit substrates can be abolished and it becomes possible to curtail the cost heretofore required for noise countermeasure.

The drive control box 72, the controller box 73 and each circuit substrate are arranged side by side on the rear surface of the apparatus so as to readily permit access thereto during maintenance. A first drive source 76, a second drive source 77, etc. for driving the apparatus main body are disposed on the back sides of the first control box 72 and the controller box 73.

The controller box 73 is slidable in a direction in which the connectors 82 and 83 are mounted and dismounted (a direction parallel to the surfaces of the circuit substrates), and the controller substrate can be mounted and dismounted with respect to the apparatus main body even if the drive control box 72 is not mounted and dismounted. Also, a space is provided at the end portion of the controller box 73 in the slide direction thereof so that the controller box 73 can slide.

The drive control box 72 is slidable in the direction in which the connectors 82 and 83 are mounted and dismounted, and the circuit substrate 70 for effecting the control of drive can be mounted and dismounted with respect to the apparatus main body even if the controller box 73 is not mounted and dismounted. Also, a space is provided at the end portion of the drive control box 72 in the slide direction thereof so that the drive control box 72 can slide.

When the controller box 73 and the drive control box 72 are to be slidden, they are slidden after screws used to mount them on the apparatus main body are removed in advance.

The controller box 73 and the drive control box 72 are designed so as to be capable of being independently mounted and dismounted (so that one box can be detached without the other box being detached) and therefore, when such maintenance as the interchange or cleaning of a motor disposed in the more inside portion of the main body than the above-described substrates is to be effected, it becomes possible to have access to driving members 76 and 77 installed in the more inside portion of the main body than the circuit substrates without removing all of the circuit substrates connected together by a cableless type connector.

Figure 4:
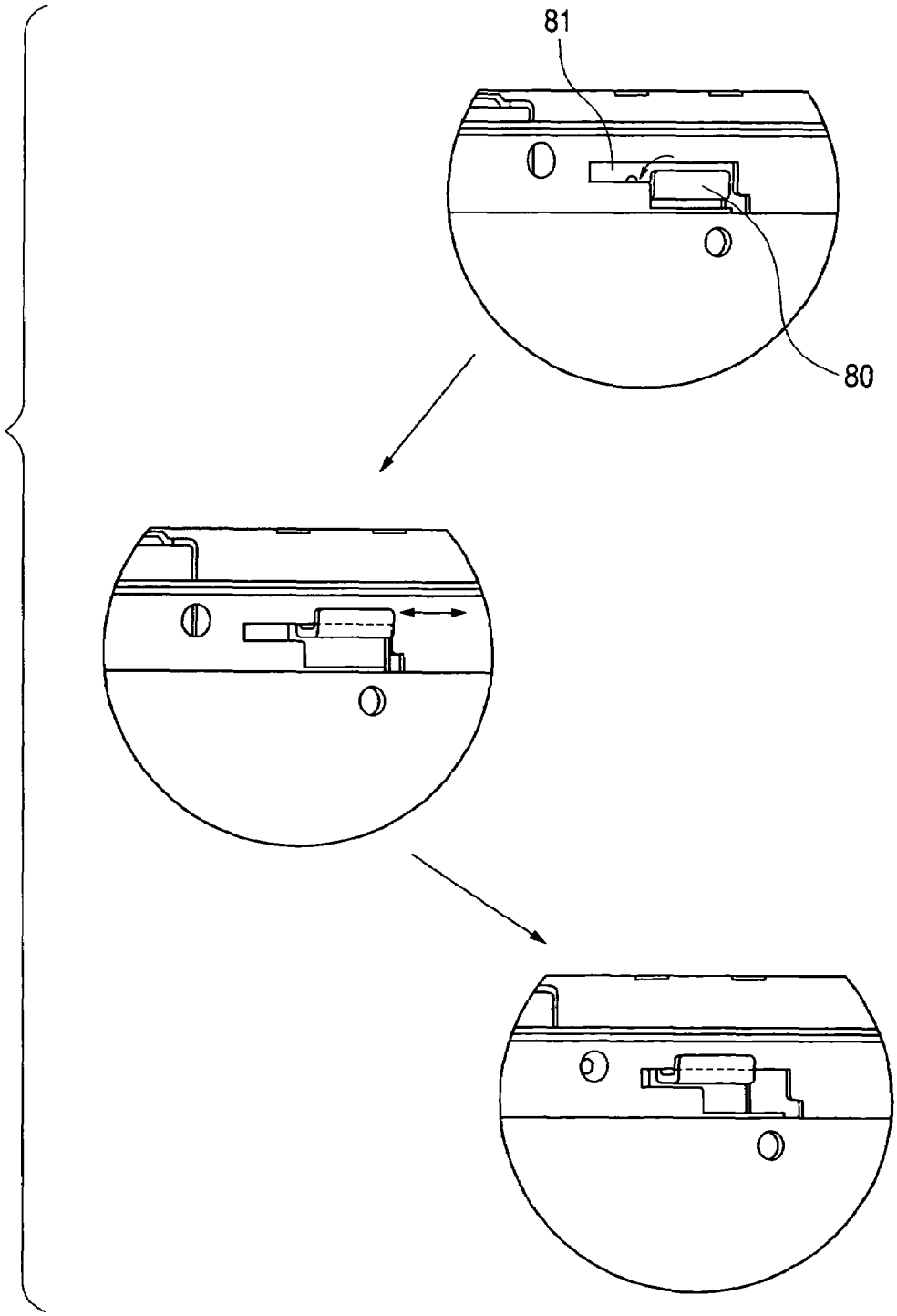
FIG. 4 is a detailed view of a hitching portion and an opening aperture for hitching.
Figure 5:
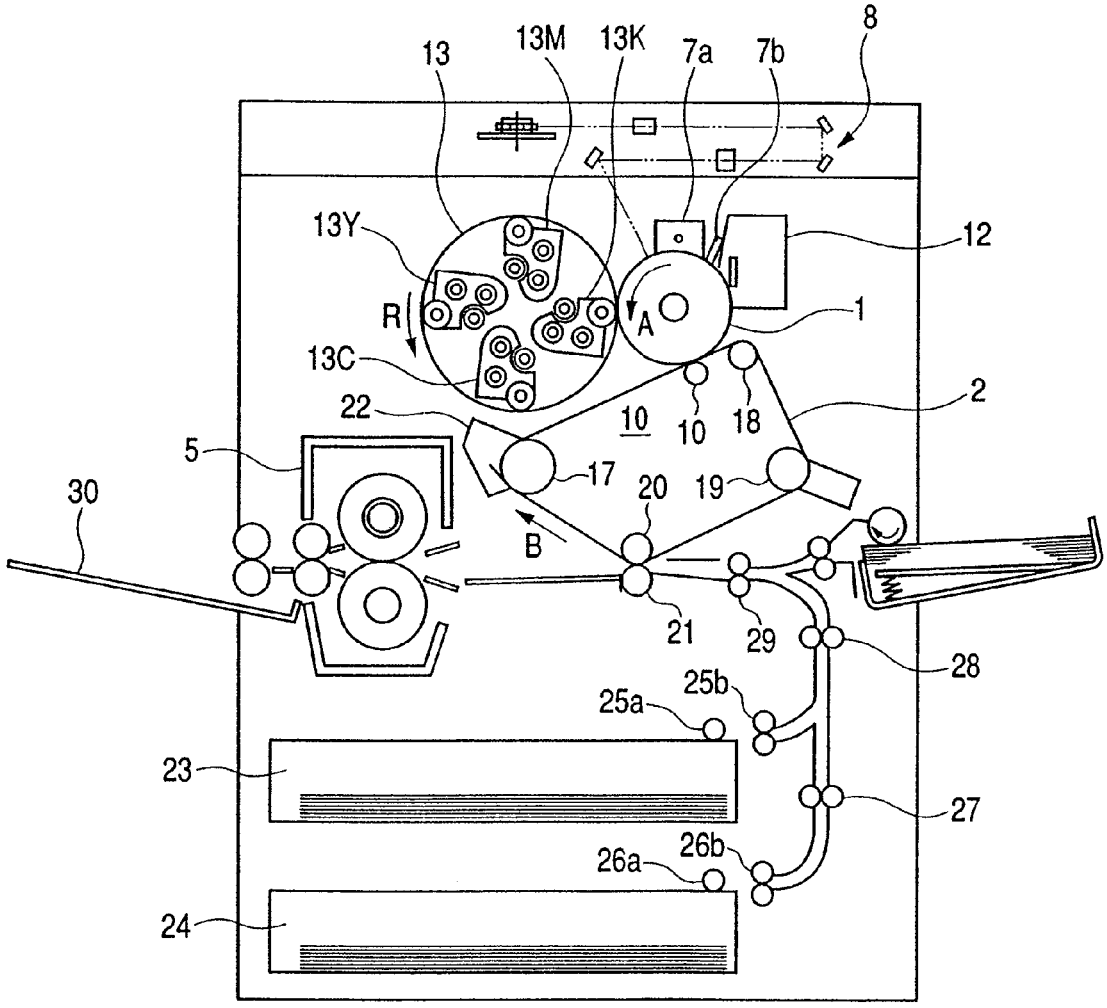
FIG. 5 (Prior Art)
FIG. 5 shows the construction of a conventional image forming apparatus.

FIG. 4 shows a detailed view of an opening aperture 81 for hitching provided in the drive control box 72 and a hitching portion 80 provided on the apparatus main body side.

The controller box 73 and the drive control box 72 are mounted in such a manner that the opening apertures 81 for hitching are hitched on the hitching portions 80 provided on the apparatus main body side. That is, the hitching portions 80 are provided as holding members for holding the controller box 73 and the drive control box 72 on the apparatus main body.

The opening aperture 81 for hitching in the drive control box 72, as shown in FIG. 4, is of a hook shape (a shape in which a corner of a rectangle is cut out in a rectangular shape), the width (a vertical direction as viewed in FIG. 4) of the left portion of the opening aperture is narrower than the width of the right portion.

In a state in which the connectors 82 and 83 are connected, the hitching portion 80 is fitted in the narrow portion of the opening aperture 81 for hitching and therefore, the movement of the drive control box 72 is limited to thereby prevent a load from being applied to the connectors from any other direction than the direction in which the connectors are mounted and dismounted.

Also, in a state in which the connection of the connectors 82 and 83 has been released, the hitching portion 80 is fitted in the wide portion of the opening aperture 81 for hitching and therefore, it becomes possible to dismount the drive control box 72 from the hitching portion 80. By constructing so, it becomes possible to dismount the drive control box 72 from the apparatus main body.

The opening aperture for hitching provided on the controller box side is of a substantially line-symmetrical shape with respect to the opening aperture provided on the drive control box side. Therefore, only in a state in which the connectors 82 and 83 on the circuit substrate are separate from each other, it is possible to hitch the opening apertures 81 for hitching in the controller box 73 and the drive control box 72 on the hitching portions 80.

Consequently, it becomes possible to avoid the problem that a load is applied from any other direction than the mounting and dismounting direction to the connectors connecting the substrates together to thereby damage the connectors, the circuit substrates, etc. That is, the controller box 73 and the drive control box 72 are of such a construction that they can be dismounted from the apparatus main body only after moved to a position in which the connection of the connectors 82 and 83 is released.

As shown in FIG. 3, the plates 30 and 31 of the image forming apparatus are designed to vertically divide the apparatus into two, and a connecting portion 40 is designed such that the portions of a metal plate bent at a right angle overlap each other. This connecting portion 40 is constituted by a grounded electrically conductive member.

An AC component cable 91 and a DC component cable 90 are installed so as to sandwich the connecting portion 40 of the plates 30 and 31 therebetween. Here, what is above the connecting portion 40 is the DC component cable 90 and what is below the connecting portion 40 is the AC component cable 91, but a converse arrangement may be adopted.

Consequently, the AC component cable 91 and the DC component cable 90 are spaced apart from each other by the connecting portion 40 which is a grounded electrically conductive member and therefore, a reduction in noise becomes possible at a low cost without adopting the countermeasure of providing a covering material for electrically shielding the surfaces of the cables.

A fixing member 35 is fixed to the plates 30 and 31 so as to cover the connecting portion 40 of the plates 30 and 31, and also has the role of a guide for the DC component cable 90 extending from the plate 31 to the plate 30 to clear the connecting portion 40.

The fixing member 35 is located between the AC component cable 91 and the DC component cable 90 so as to space the AC component cable 91 and the DC component cable 90 apart from each other. The fixing member 35 is constituted by a grounded electrically conductive member.

By adopting such a construction, it becomes possible to avoid the problem that noise shifts from the AC component cable 91 onto the DC component cable 90.

Also, it becomes possible to protect the cables from the edge of the connecting portion 40 of the plates 30 and 31 and therefore, a wire saddle and an edge saddle or the like can be omitted, and it becomes possible to curtail the cost.

While the present invention has been shown with respect to an example in which it is applied to an image forming apparatus, it is applicable to various electronic apparatuses having a plurality of circuit substrates.

Also, the present invention is not restricted to the above-described embodiment, but various modifications thereof are possible.

What is claimed is:

1. An image forming apparatus comprising:

a first circuit substrate;

a second circuit substrate;

a first supporting member for supporting said first circuit substrate;

a second supporting member for supporting said second circuit substrate;

a holding member for holding said first supporting member and said second supporting member; and a connector for electrically and cablelessly connecting said first circuit substrate and said second circuit substrate together, wherein first supporting member and said second supporting member are movable in a direction in which the connection by said connector is released, and said first supporting member and said second supporting member are mountable to and dismountable from said holding member independently of each other, and if the connection by said connector is not released, said first supporting member and said second supporting member cannot be dismounted from said holding member.

2. An image forming apparatus according to claim 1, wherein a space is provided in a direction of movement of at least one of said first supporting member and said second supporting member so that said at least one supporting member can be moved in the direction in which the connection by said connector is released.

3. An image forming apparatus according to claim 1, wherein the connection by said connector is released, whereby the mounting and dismounting of said first supporting member and said second supporting member becomes possible.

4. An image forming apparatus according to claim 1, comprising an image forming portion for forming an image on a recording medium, wherein said first circuit substrate and said second circuit substrate are circuit substrates for controlling an operation of said image forming portion.

* * * * *

UNITED STATES PATENT AND TRADEMARK OFFICE

CERTIFICATE OF CORRECTION

PATENT NO. : 7,343,117 B2
APPLICATION NO. : 10/836208
DATED : March 11, 2008
INVENTOR(S) : Otoguro et al.

It is certified that error appears in the above-identified patent and that said Letters Patent is hereby corrected as shown below:

COLUMN 7:

Line 4, "wherein" should read -- wherein said --.

Signed and Sealed this

Eleventh Day of November, 2008

JON W. DUDAS
*Director of the United States Patent and Trademark Office*